US009026006B2

(12) United States Patent
Kawai

(10) Patent No.: US 9,026,006 B2
(45) Date of Patent: May 5, 2015

(54) IMAGE FORMING APPARATUS

(71) Applicant: Fuji Xerox Co., Ltd., Minato-ku, Tokyo (JP)

(72) Inventor: Jun Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/943,104

(22) Filed: Jul. 16, 2013

(65) Prior Publication Data

US 2013/0302066 A1 Nov. 14, 2013

(30) Foreign Application Priority Data

Mar. 26, 2013 (JP) ..... 2013-064999

(51) Int. Cl.
*G03G 15/00* (2006.01)

(52) U.S. Cl.
CPC ..... *G03G 15/50* (2013.01)

(58) Field of Classification Search
USPC ..... 399/110, 111, 121, 167, 302, 303; 192/82, 89.2
See application file for complete search history.

(56) References Cited

U.S. PATENT DOCUMENTS 5,668,424 A * 9/1997 Lamb ..... 310/103
8,090,296 B2 * 1/2012 Ito et al. ..... 399/167
2008/0207336 A1 8/2008 Yokoyama
2009/0123181 A1 * 5/2009 Ito et al. ..... 399/167
2010/0296841 A1 * 11/2010 Yuasa ..... 399/167

FOREIGN PATENT DOCUMENTS

JP 2008-202757 A 9/2008

* cited by examiner

*Primary Examiner* — Francis Gray
(74) *Attorney, Agent, or Firm* — Sughrue Mion, PLLC

(57) ABSTRACT

An image forming apparatus includes a housing; a driving portion provided in the housing and configured to generate a driving force; an interchangeable member interchangeably provided in the housing and having a driving-force-receiving portion at which the driving force is received, the interchangeable member being configured to rotate by receiving the driving force at the driving-force-receiving portion; a driving-force-transmitting portion provided in the housing and connecting the driving portion and the interchangeable member to each other, the driving-force-transmitting portion being configured to transmit the driving force from the driving portion to the interchangeable member; and a connecting-and-disconnecting mechanism that allows the driving force to be transmitted between the driving portion and the driving-force-transmitting portion when the interchangeable member rotates, and prevents the driving force from being transmitted between the driving portion and the driving-force-transmitting portion when the interchangeable member is to be attached to the housing.

4 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2013-064999 filed Mar. 26, 2013.

BACKGROUND

Technical Field

The present invention relates to an image forming apparatus.

SUMMARY

According to an aspect of the invention, there is provided an image forming apparatus including a housing; a driving portion provided in the housing and configured to generate a driving force; an interchangeable member interchangeably provided in the housing and having a driving-force-receiving portion at which the driving force generated by the driving portion is received, the interchangeable member being configured to rotate by receiving the driving force at the driving-force-receiving portion; a driving-force-transmitting portion provided in the housing and connecting the driving portion and the interchangeable member to each other, the driving-force-transmitting portion being configured to transmit the driving force from the driving portion to the interchangeable member; and a connecting-and-disconnecting mechanism that allows the driving force to be transmitted between the driving portion and the driving-force-transmitting portion when the interchangeable member rotates by receiving the driving force from the driving portion, and prevents the driving force from being transmitted between the driving portion and the driving-force-transmitting portion when the interchangeable member is to be attached to the housing.

BRIEF DESCRIPTION OF THE DRAWINGS

An exemplary embodiment of the present invention will be described in detail based on the following figures, wherein.

DETAILED DESCRIPTION

Configuration of Image Forming Apparatus 1

Figure 1:
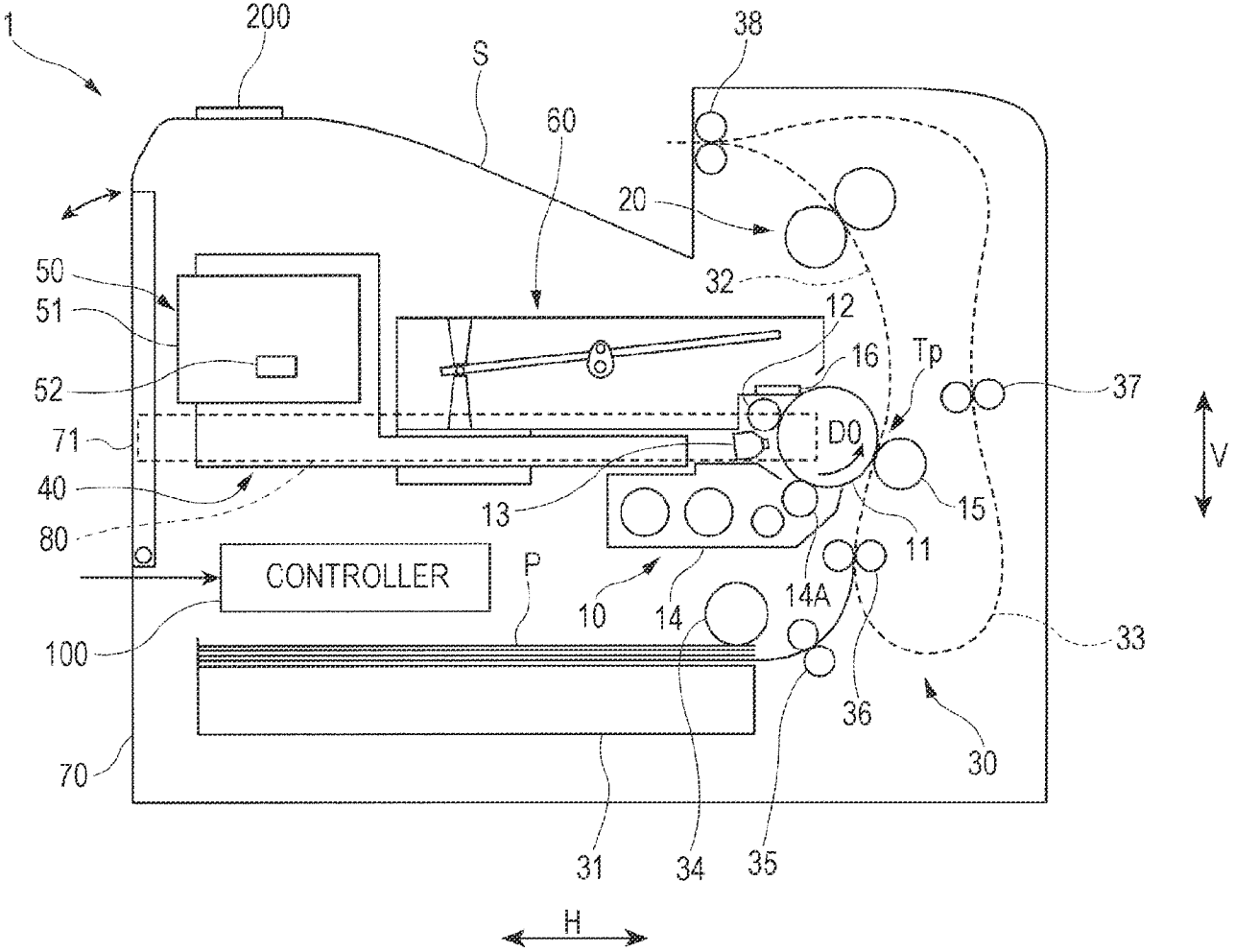
FIG. 1 illustrates an overall configuration of an image forming apparatus according to the exemplary embodiment.

Referring to FIG. 1, a configuration of an image forming apparatus 1 according to an exemplary embodiment of the present invention will first be described. FIG. 1 illustrates an overall configuration of the image forming apparatus 1 according to the exemplary embodiment.

The image forming apparatus 1 includes an image forming section 10 that forms a toner image on each piece of paper P, a fixing section 20 that fixes the toner image formed on the piece of paper P by the image forming section 10, and a paper transport system 30 that supplies each piece of paper P to the image forming section 10.

The image forming apparatus 1 further includes a toner transport section 40 that transports toner to the image forming section 10, a toner cartridge 50 that is provided in the toner transport section 40 and stores toner to be supplied to the image forming section 10, and a toner collecting device 60 that collects residual toner (to be described below) on a photoconductor drum 11 provided in the image forming section 10.

The image forming apparatus 1 further includes a controller 100 and a user interface (UI) 200. The controller 100 controls all operations performed by the image forming section 10, the fixing section 20, the paper transport system 30, the toner transport section 40, the toner cartridge 50, and the toner collecting device 60. The UI 200 includes a display panel, through which the UI 200 receives instructions from the user and displays messages and so forth to the user. The image forming apparatus 1 further includes a housing 70 that supports the above elements, and a link mechanism 80 that is connected to a covering 71 included in the housing 70.

Hereinafter, the near side and the far side of the image forming apparatus 1 illustrated in FIG. 1 are also referred to as "front side" and "rear side", respectively. Furthermore, the horizontal direction and the vertical direction of the image forming apparatus 1 illustrated in FIG. 1 are also simply denoted as "horizontal direction H" and "vertical direction V", respectively. Furthermore, the direction of the rotational axis of the photoconductor drum 11 (to be described below) included in the image forming apparatus 1 is also simply referred to as "axial direction".

The image forming section 10 includes the photoconductor drum 11, a charging device 12 that charges the photoconductor drum 11, an exposure device 13 that performs exposure on the photoconductor drum 11, a developing device 14 that performs development on the photoconductor drum 11 that has been charged, a transfer device 15 that transfers a toner image formed on the photoconductor drum 11 to a piece of paper P, and a cleaning member 16 that cleans the photoconductor drum 11 after the transfer.

The photoconductor drum 11 includes a photosensitive layer (not illustrated) on the outer circumference thereof and rotates in a forward direction (a direction of arrow D0 in FIG. 1). The photoconductor drum 11 is detachably attached to the housing 70. The attaching and detaching of the photoconductor drum 11 are performed through an open portion (not illustrated) that appears when the covering 71 included in the housing 70 is opened.

The housing 70 includes urging portions (not illustrated) such as springs that urge the photoconductor drum 11 in the horizontal direction H and the vertical direction V, and pressed portions (not illustrated) provided inside the housing 70 and against which the photoconductor drum 11 urged by the urging portions is pressed. The urging portions and the pressed portions in combination determine the position of the photoconductor drum 11 in the horizontal direction H and the vertical direction V. Hence, even if a gear-side magnet 125 or a drum-side magnet 117 (to be described below) is attached to a deflected position, vibrations that may occur in the photoconductor drum 11 because of the deflection are suppressed. The positioning of the photoconductor drum 11 in the axial direction will be described separately below.

The charging device 12 includes a charging roller provided in contact with the photoconductor drum 11 and charges the photoconductor drum 11 to a predetermined potential.

The exposure device 13 applies a laser beam to the photoconductor drum 11 so as to selectively perform exposure on the photoconductor drum 11 that has been charged by the charging device 12, whereby the exposure device 13 forms an electrostatic latent image on the photoconductor drum 11.

The developing device 14 stores two-component developer containing, for example, toner that is negatively charged and a carrier that is positively charged. The developing device 14 develops, with the toner, the electrostatic latent image formed on the photoconductor drum 11 with the aid of a developing roller 14A, thereby forming a toner image on the photoconductor drum 11.

The transfer device 15 includes a roller member and transfers the toner image on the photoconductor drum 11 to a piece of paper P by producing an electric field at a position (transfer part Tp) between the transfer device 15 and the photoconductor drum 11.

The cleaning member 16 is a plate-like member made of an elastic material such as thermosetting urethane rubber and having a predetermined thickness. The cleaning member 16 extends in the axial direction and is in contact with the surface of the photoconductor drum 11. The cleaning member 16 removes toner and so forth (hereinafter referred to as residual toner) remaining on the photoconductor drum 11 after the transfer of the toner image.

In the exemplary embodiment, the cleaning member 16 is provided on the downstream side with respect to the transfer device 15 in the direction of rotation of the photoconductor drum 11 and is in contact with the surface of the photoconductor drum 11 along the tangent line to the photoconductor drum 11.

The fixing section 20 includes a pressure roller and a heat roller (both not illustrated). The piece of paper P having the toner image transferred thereto is made to pass through the nip between the rollers, whereby the fixing section 20 fixes the toner image on the piece of paper P through a fixing process using heat and pressure.

The paper transport system 30 includes a paper storing portion 31 that stores plural pieces of paper P, a paper transport path 32 along which each piece of paper P is transported and that extends from the paper storing portion 31 through the transfer part Tp and the fixing section 20 to a paper stacking portion S on which the piece of paper P is to be stacked, and a reversal transport path 33 in which the piece of paper P having passed through the fixing section 20 is turned upside down and is supplied to the transfer part Tp again.

The paper transport system 30 includes a pickup roller 34 that picks up some pieces of paper P from the paper storing portion 31 storing plural pieces of paper P, and a pair of separating rollers 35 that separate one of the pieces of paper P from the others and transport the piece of paper P toward the transfer part Tp.

The paper transport system 30 further includes a pair of registration rollers 36 that temporarily stop the transportation of the piece of paper P when not rotated, and supply the piece of paper P to the transfer part Tp by rotating at a predetermined timing while registering the piece of paper P.

The paper transport system 30 further includes a pair of transport rollers 37 that are provided on the reversal transport path 33 and transport the piece of paper P, and a pair of discharge rollers 38 that are provided on the downstream side in a paper transport direction with respect to a position where the paper transport path 32 and the reversal transport path 33 merge. The pair of discharge rollers 38 discharge the piece of paper P having undergone fixing toward the paper stacking portion S, or transport the piece of paper P toward the reversal transport path 33 when images are to be formed on both sides of the piece of paper P.

The toner transport section 40 holds the toner cartridge 50, which is interchangeable. The toner transport section 40 transports toner supplied thereto from the toner cartridge 50 toward the developing device 14 included in the image forming section 10.

The toner cartridge 50 includes a toner container 51 and a storage medium 52. The toner container 51 contains toner. The storage medium 52 is an electrically erasable and programmable read-only memory (EEPROM) or the like. The storage medium 52 stores information indicating the type of the toner cartridge 50, and information on the usage condition of the toner cartridge 50 such as the number of revolutions of a rotating member provided in the toner container 51 and that rotates and thus stirs the toner. If, for example, the toner in the toner container 51 runs out, the toner cartridge 50 is replaced with another toner cartridge 50.

The toner collecting device 60 collects and stores the residual toner removed from the photoconductor drum 11 by the cleaning member 16 after the transfer.

The controller 100 receives image data and printing instructions for image formation from a personal computer (PC) or the like that is connected to the image forming apparatus 1 over a network or the like. Furthermore, the controller 100 processes the image data thus received and sends the processed image data to the exposure device 13.

The controller 100 according to the exemplary embodiment includes a central processing unit (CPU), a read-only memory (ROM), a random access memory (RAM), and a hard disk drive (HDD) (all not illustrated). The CPU executes processing programs. The ROM stores programs, tables, parameters, and so forth. The RAM is used as a work area or the like when any of the programs is executed by the CPU.

Operation Performed by Image Forming Apparatus 1

An image forming operation performed by the image forming apparatus 1 according to the exemplary embodiment will now be described.

When image data generated by the PC or the like (not illustrated) is received by the controller 100, the controller 100 processes the image data. The image data thus processed is output to the exposure device 13. The exposure device 13 that have acquired the image data selectively performs exposure on the photoconductor drum 11 that has been charged by the charging device 12, thereby forming an electrostatic latent image on the photoconductor drum 11. The electrostatic latent image on the photoconductor drum 11 is developed into a toner image in, for example, black (K) by the developing device 14.

Meanwhile, in the paper transport system 30, the pickup roller 34 rotates in accordance with the timing of image formation, and some pieces of paper P are picked up from the paper storing portion 31. One of the pieces of paper P that has been separated from the others by the pair of separating rollers 35 is transported to the pair of registration rollers 36, where the piece of paper P is temporarily stopped. The pair of registration rollers 36 rotate in accordance with the timing of rotation of the photoconductor drum 11, whereby the piece of paper P is supplied to the transfer part Tp, where the toner image formed on the photoconductor drum 11 is transferred to the piece of paper P by the transfer device 15.

Subsequently, the piece of paper P having the toner image transferred thereto undergoes the fixing process in the fixing section 20, and is discharged to the paper stacking portion S by the pair of discharge rollers 38.

If another image is to be formed on a second side of the piece of paper P in addition to a first side of the piece of paper P (if images are to be formed on both sides of the piece of paper P), the piece of paper P that has passed through the fixing section 20 is transported into the reversal transport path 33 by the pair of discharge rollers 38 and is supplied to the transfer part Tp again by the pair of transport rollers 37. Then, another toner image formed on the photoconductor drum 11 is transferred to the second side of the piece of paper P at the transfer part Tp. The piece of paper P having the toner image transferred also to the second side thereof undergoes the fixing process in the fixing section 20 and is discharged onto the paper stacking portion S by the pair of discharge rollers 38.

After the above image formation is performed by the image forming section 10 and the toner image on the photoconductor drum 11 is transferred to the piece of paper P, the photoconductor drum 11 may have some residual toner. Such residual toner on the photoconductor drum 11 is removed by the cleaning member 16. The residual toner thus removed is collected by the toner collecting device 60.

Photoconductor Drum 11

Figure 2:
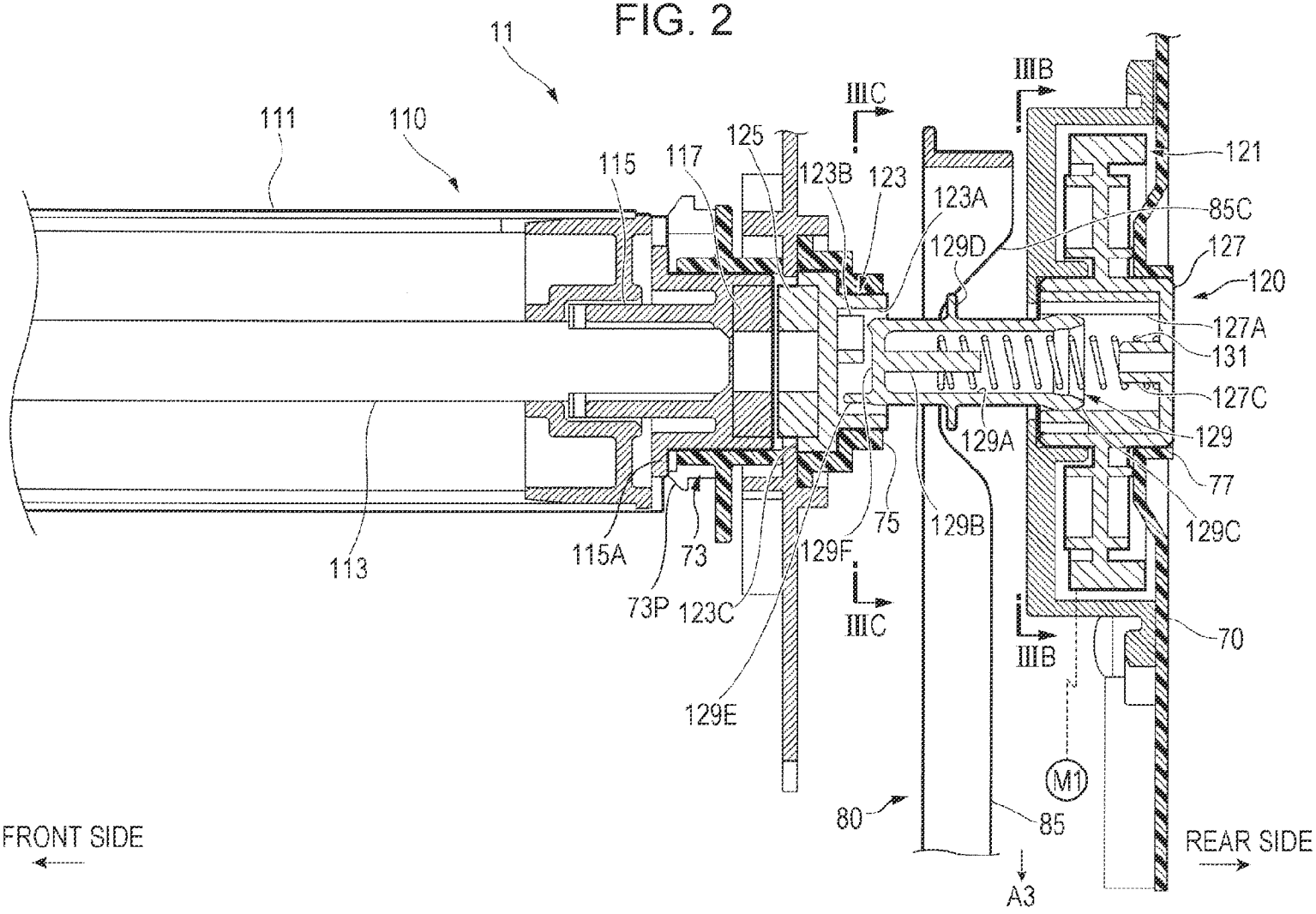
FIG. 2 is a schematic diagram illustrating a rear-side end of a photoconductor drum according to the exemplary embodiment.

Referring now to FIG. 2, a configuration including the photoconductor drum 11 and peripheral elements according to the exemplary embodiment will be described. FIG. 2 is a schematic diagram illustrating a rear-side end of the photoconductor drum 11 according to the exemplary embodiment.

As illustrated in FIG. 2, the photoconductor drum 11 includes a photoconductor drum unit 110 and a photoconductor-drum-driving mechanism 120 that transmits a driving force to the photoconductor drum unit 110. The photoconductor drum unit 110 and the photoconductor-drum-driving mechanism 120 are supported by the housing 70. The transmission of the driving force from the photoconductor-drum-driving mechanism 120 is cut by the link mechanism 80 (to be described in detail below).

Photoconductor Drum Unit 110

The photoconductor drum unit 110, which is an exemplary interchangeable member, includes a cylindrical photoconductor drum body 111 configured to carry a toner image on the outer circumferential surface thereof, a shaft 113 functioning as a rotating shaft of the photoconductor drum body 111, a drum-side-magnet-supporting member 115 provided at the rear-side end of the shaft 113 and rotating together with the shaft 113, and a drum-side magnet 117 (to be described below) supported by the drum-side-magnet-supporting member 115 coaxially with the shaft 113.

The above elements integrally form the photoconductor drum unit 110. The photoconductor drum unit 110 is detachably attached to the housing 70. More specifically, the photoconductor drum unit 110 illustrated in FIG. 2 is attached to the housing 70 in a direction intersecting the axial direction of the photoconductor drum unit 110 and from the near side toward the far side in FIG. 2. A driving force generated by the photoconductor-drum-driving mechanism 120 causes the photoconductor drum unit 110 as a whole to rotate about the shaft 113.

Photoconductor-Drum-Driving Mechanism 120

The photoconductor-drum-driving mechanism 120, which is an exemplary driving-force-transmitting portion, includes motor M1 as a drive source (driving portion), a train of gears (not illustrated) each rotating with the driving force transmitted thereto from the motor M1, a coupling gear 121 rotating with the driving force transmitted thereto from the train of gears, a gear-side-magnet-supporting member (follower portion) 123 rotating with the driving force transmitted thereto from the coupling gear 121, and a gear-side magnet 125 supported by the gear-side-magnet-supporting member 123. The coupling gear 121, the gear-side-magnet-supporting member 123, and the gear-side magnet 125 are coaxial with the shaft 113.

The coupling gear 121 includes a gear body 127, a coupling pin (rotating portion) 129 coaxial with the gear body 127 and movable in the axial direction, and a spring 131 urging the coupling pin 129 in a direction of the rotational axis of the gear body 127 toward the photoconductor drum 11 (the front side).

The gear body 127 has a coupling-pin-receiving hole 127A that is open from the front-side face thereof and extending coaxially with the gear body 127. The coupling-pin-receiving hole 127A receives the coupling pin 129 and the spring 131 and has dimensions that allow the coupling pin 129 to move along the rotational axis of the gear body 127.

The gear body 127 has grooves 127B (see FIG. 3B to be referred to below) provided on the inner circumferential surface of the coupling-pin-receiving hole 127A and extending along the rotational axis of the gear body 127. In an exemplary configuration illustrated in FIG. 3B, two grooves 127B are provided across the rotational axis of the gear body 127 from each other.

The gear body 127 includes a holding member 127C that is a substantially columnar member extending in the coupling-pin-receiving hole 127A and coaxially with the coupling-pin-receiving hole 127A. A portion of the spring 131 is wound around and is thus held by the holding member 127C.

Figure 3A:
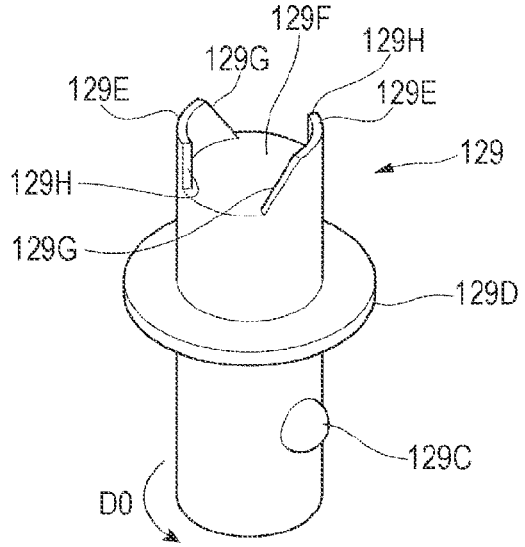
FIGS. 3A to 3C are schematic diagrams of a coupling pin.
Figure 3B:
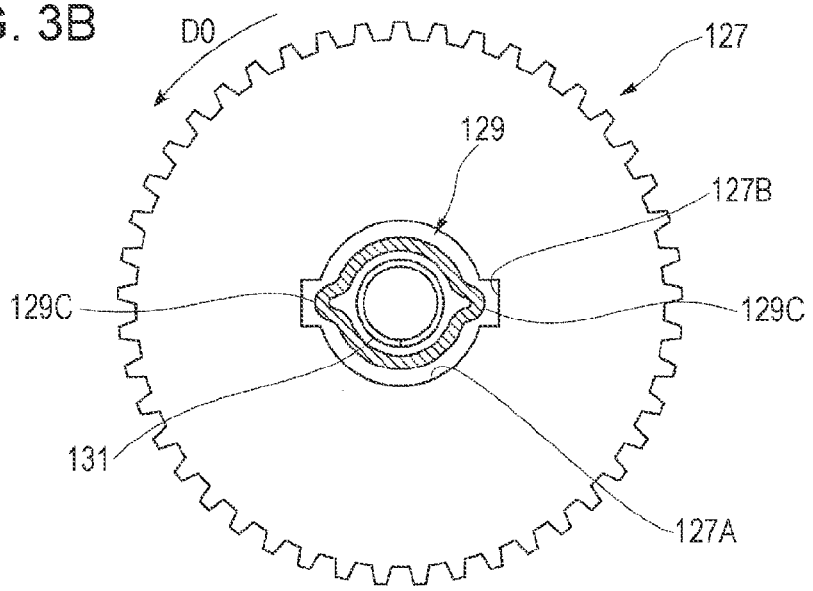
Figure 3C:
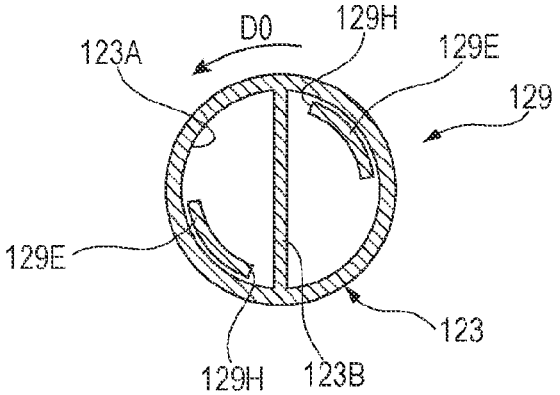

Referring now to FIGS. 2 and 3A to 3C, the coupling pin 129 will be described. FIGS. 3A to 3C are schematic diagrams of the coupling pin 129. More specifically, FIG. 3A is a perspective view of the coupling pin 129 seen from the front side. FIG. 3B is a sectional view taken along line IIIB-IIIB in FIG. 2 and illustrates the relationship between the coupling pin 129 and the gear body 127. FIG. 3C is a sectional view taken along line IIIC-IIIC in FIG. 2 and illustrates the relationship between the coupling pin 129 and the gear-side-magnet-supporting member 123.

As illustrated in FIGS. 2 and 3A, the coupling pin 129 is a substantially cylindrical member with one end (the rear-side end) thereof fitted in the coupling-pin-receiving hole 127A provided in the gear body 127. In the exemplary configuration illustrated in FIGS. 2 and 3A, the coupling pin 129 has a spring-receiving hole 129A extending in the axial direction thereof from an end (rear-side end) thereof facing the gear body 127. Furthermore, the coupling pin 129 includes a limiting portion 129B that is a substantially columnar member extending in the axial direction of the coupling pin 129 and provided at the bottom of the spring-receiving hole 129A. The limiting portion 129B limits the movement of the spring 131, provided in the spring-receiving hole 129A, in the radial direction.

The coupling pin 129 further includes projections 129C provided near the rear-side end on the outer circumferential surface thereof, a flange 129D (to be described in detail below) provided around the outer circumference thereof and at a position nearer to the front side than the projections 129C, and catches 129E projecting from a front-side end facet 129F thereof toward the front side.

In the exemplary configuration illustrated in FIGS. 3A and 3B, two projections 129C are provided across the rotational axis of the coupling pin 129 from each other, and the projections 129C each have a substantially hemispherical shape on the outer circumferential surface of the coupling pin 129.

In the state where the coupling pin 129 is set in the coupling-pin-receiving hole 127A of the gear body 127 as illustrated in FIG. 3B, the projections 129C of the coupling pin 129 reside in the respective grooves 127B of the gear body 127. Hence, in the coupling-pin-receiving hole 127A of the gear body 127, the movement (relative movement) of the coupling pin 129 in the circumferential direction is limited while the movement (relative movement) of the coupling pin 129 in the axial direction is not limited.

Referring to FIG. 3A again, the catches 129E will be described. In the exemplary configuration illustrated in FIG. 3A, two catches 129E are provided across the rotational axis of the coupling pin 129 from each other. The catches 129E are each a plate-like member provided on the front-side end facet 129F of the coupling pin 129 and curving in the circumferential direction of the coupling pin 129. The catches 129E each have, at one end thereof in the circumferential direction, a sloping portion 129G sloping in a direction intersecting the front-side end facet 129F of the coupling pin 129.

Referring to FIG. 3C, the catches 129E of the coupling pin 129 are set in a recess 123A (to be described below) provided in the gear-side-magnet-supporting member 123. When the coupling pin 129 is driven to rotate about the rotational axis thereof, ends 129H of the respective catches 129E that are opposite the sloping portions 129G push a rib 123B (to be described below) provided in the recess 123A, thereby rotating the gear-side-magnet-supporting member 123 (see arrow D0 in FIG. 3C). In this manner, the driving force is transmitted from the coupling pin 129 to the gear-side-magnet-supporting member 123.

Referring to FIG. 2 again, the gear-side-magnet-supporting member 123 and the gear-side magnet 125 will be described.

As illustrated in FIG. 2, the gear-side-magnet-supporting member 123 has, at the rear-side end thereof, the recess 123A in a region facing the coupling pin 129. Furthermore, the rib 123B is provided in the recess 123A. The rib 123B projects from the bottom of the recess 123A and extends in the diametrical direction. The rib 123B resides in a path along which the catches 129E move with the rotation of the coupling pin 129.

The gear-side-magnet-supporting member 123 includes a holding portion 123C provided at the front-side end thereof and that holds the gear-side magnet 125. In the exemplary configuration illustrated in FIG. 2, the holding portion 123C is an annular member that holds the gear-side magnet 125 at the inner circumference thereof.

The gear-side magnet 125 that is held by the gear-side-magnet-supporting member 123 is coaxial with the drum-side magnet 117 and faces the drum-side magnet 117.

Figure 4A:
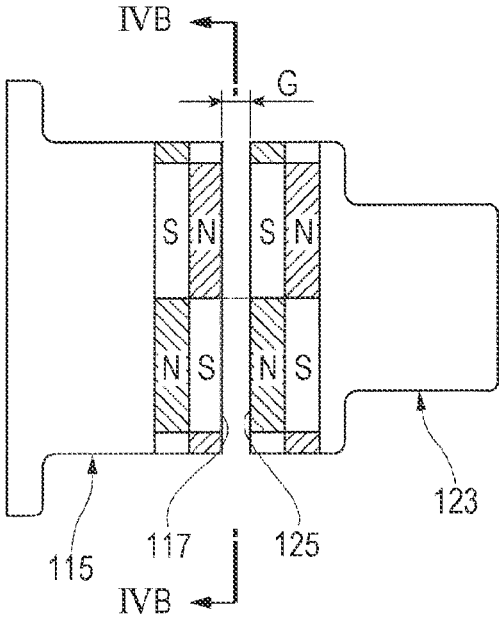
FIGS. 4A and 4B illustrate configurations of a drum-side magnet and a gear-side magnet.
Figure 4B:
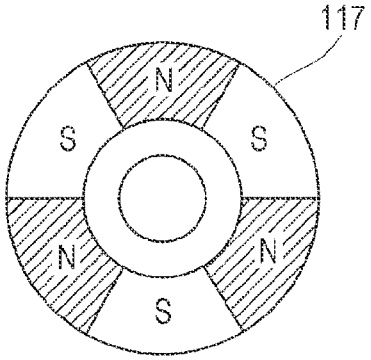

Referring now to FIGS. 4A and 4B, configurations of the drum-side magnet 117 and the gear-side magnet 125 will be described. FIGS. 4A and 4B illustrate the configurations of the drum-side magnet 117 and the gear-side magnet 125. More specifically, FIG. 4A illustrates the positional relationship between the drum-side magnet 117 and the gear-side magnet 125 that is realized when the two rotate together. FIG. 4B schematically illustrates the drum-side magnet 117 seen in a direction indicated by arrows IVB in FIG. 4A.

The drum-side magnet (a driving-force-receiving portion, or a second magnet) 117 and the gear-side magnet (a first magnet) 125 are each an annular plate-type magnet. As illustrated in FIG. 4B, the drum-side magnet 117 includes magnets arranged in the circumferential direction thereof such that the magnetic poles of adjacent magnets have opposite polarities. While three pairs of opposite magnetic polarities, the north pole and the south pole, are provided in the circumferential direction in the exemplary configuration illustrated in FIG. 4B, the number of pairs is not limited to three. The gear-side magnet 125 has the same configuration as the drum-side magnet 117, although not illustrated.

The gear-side magnet 125 and the drum-side magnet 117 in combination form a so-called magnet coupling. More specifically, each magnetic pole of each of the gear-side magnet 125 and the drum-side magnet 117 faces the opposite magnetic pole of the other with a gap (denoted by G in FIG. 4A) interposed therebetween. The gap G falls within a range in which the magnets 125 and 117 attract each other. When the gear-side magnet 125 is driven to rotate by the motor M1 of the photoconductor-drum-driving mechanism 120, the drum-side magnet 117 rotates. In this manner, the driving force from the motor M1 of the photoconductor-drum-driving mechanism 120 is transmitted to the photoconductor drum 11.

In the exemplary embodiment, the driving force is transmitted between the gear-side magnet 125 and the drum-side magnet 117 that are not in contact with each other. Therefore, noise is smaller and recycling is easier than in the case of a contact-type coupling. Furthermore, the deterioration of image quality, such as density nonuniformity (banding), caused by a resonance in the photoconductor drum 11 due to torsional rigidity may be suppressed.

Since the gear-side magnet 125 and the drum-side magnet 117 attract each other with their magnetism, the position of the photoconductor drum unit 110 in the axial direction is determined. More specifically, since a flange 115A (see FIG. 2) included in the drum-side-magnet-supporting member 115 is pressed against a positioning portion 73P (see FIG. 2) included in the housing 70, the position of the photoconductor drum unit 110 in the axial direction is determined.

Housing 70

Referring now to FIG. 2, how the housing 70 according to the exemplary embodiment supports the photoconductor drum unit 110 and the photoconductor-drum-driving mechanism 120 will be described.

As illustrated in FIG. 2, the housing 70 includes a first bearing (not illustrated), a second bearing 73, a third bearing 75, and a fourth bearing 77 that support the photoconductor drum unit 110 and the photoconductor-drum-driving mechanism 120 while allowing the rotation of the two. The first bearing (not illustrated), the second bearing 73, the third bearing 75, and the fourth bearing 77 are provided in that order in the axial direction from the front side toward the rear side and are each a sliding bearing (oil-less bearing) made of resin or the like.

The first bearing (not illustrated) and the second bearing 73 support the front-side end and the rear-side end, respectively, of the shaft 113.

The second bearing 73 supports the drum-side-magnet-supporting member 115 while allowing the rotation of the drum-side-magnet-supporting member 115. As mentioned above, the second bearing 73 includes the positioning portion 73P against which the flange 115A of the drum-side-magnet-supporting member 115 is pressed.

The third bearing 75 supports the gear-side-magnet-supporting member 123 while allowing the rotation of the gear-side-magnet-supporting member 123 and in such a manner as to hold both axial ends of the gear-side-magnet-supporting member 123. In this manner, the third bearing 75 suppresses the movement of the gear-side-magnet-supporting member 123 in the axial direction.

The fourth bearing 77 supports the coupling gear 121 while allowing the rotation of the coupling gear 121 and in such a manner as to hold both axial ends of the coupling gear 121. In this manner, the fourth bearing 77 suppresses the movement of the coupling gear 121 in the axial direction. The fourth bearing 77 also functions as a covering portion covering the coupling gear 121 and includes projecting portions 77A (see FIG. 7A to be referred to below) that guide the movement of a third link 85 (to be described below).

Link Mechanism 80

Figure 5A:
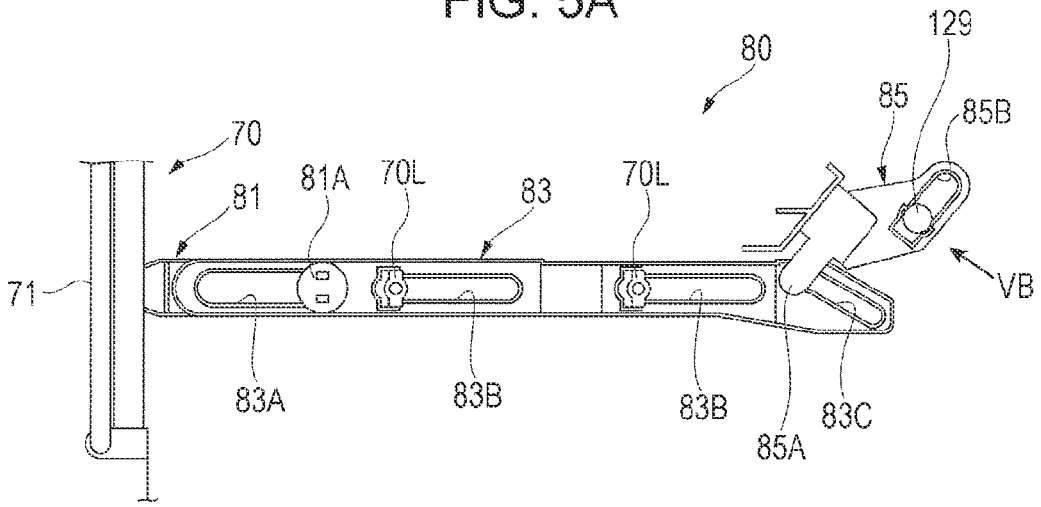
FIGS. 5A and 5B illustrate a configuration of a link mechanism.
Figure 5B:
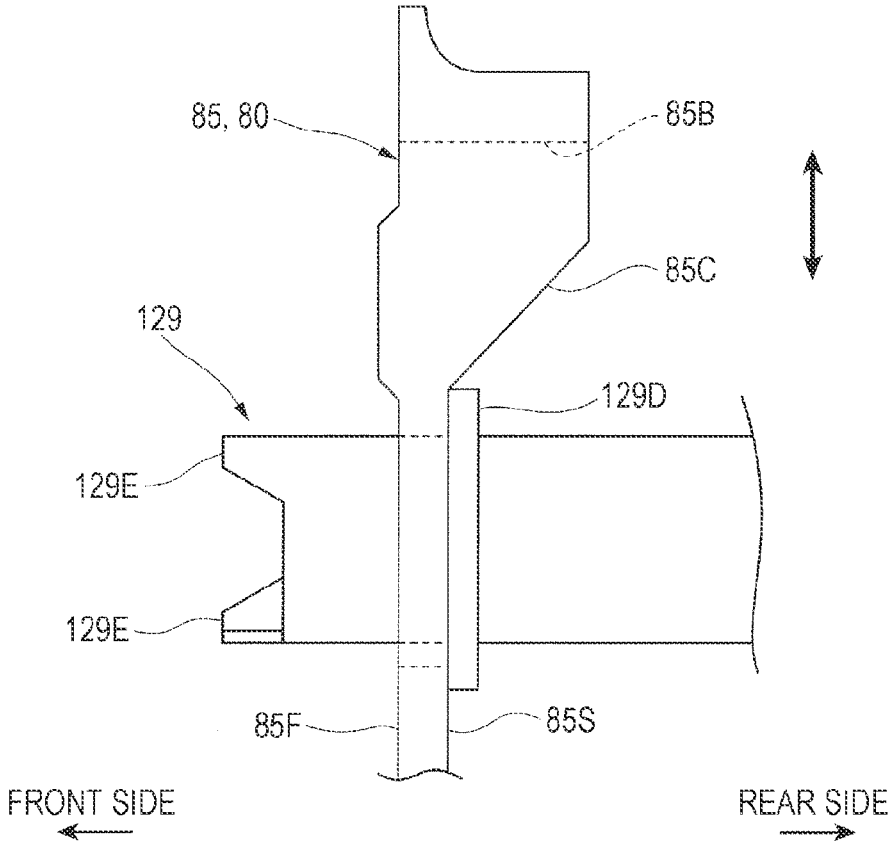

Referring now to FIGS. 5A and 5B, the link mechanism 80 according to the exemplary embodiment will be described. FIGS. 5A and 5B illustrate a configuration of the link mechanism 80. More specifically, FIG. 5A is a schematic diagram of the link mechanism 80. FIG. 5B illustrates the third link 85 and the coupling pin 129 seen in a direction of arrow VB in FIG. 5A.

As illustrated in FIG. 5A, the link mechanism 80, which is an exemplary connecting-and-disconnecting mechanism, includes a first link 81 connected to the covering (covering member) 71 that forms a part of the housing 70, a second link 83 connected to the first link 81, and the third link 85 connecting the second link 83 and the coupling pin 129 to each other.

The first link 81 is a substantially rectangular plate-like member and includes a first link pin 81A provided at one end thereof. The other end of the first link 81 is connected to the covering 71. The one end of the first link 81 is connected to the second link 83 with the first link pin 81A.

The second link 83 is a substantially rectangular plate-like member and has a first slit 83A receiving the first link pin 81A of the first link 81, second slits 83B each receiving a corresponding one of second link pins 70L provided on the housing 70, and a third slit 83C receiving a third link pin 85A provided on the third link 85. The slits 83A, 83B, and 83C extend in the longitudinal direction of the second link 83.

The third link 85 is a substantially rectangular plate-like member and includes the above-mentioned third link pin 85A at one end thereof. Furthermore, the third link 85 has a fourth slit 85B at the other end thereof. The coupling pin 129 is movably held by the fourth slit 85B. As illustrated in FIG. 5B, the third link 85 has a sloping portion 85C on a rear-side face 85S thereof. The sloping portion 85C slopes toward the other end (the upper end in FIG. 5B) of the third link 85 and away from a front-side face 85F of the third link 85.

As illustrated in FIG. 5B, the coupling pin 129 is set in the fourth slit 85B of the third link 85, and the rear-side face 85S of the third link 85 is pressed against the flange 129D of the coupling pin 129. When the covering 71 is opened or closed, the third link 85 moves down or up in FIG. 5B (as represented by the double-headed arrow in FIG. 5B and to be described in detail below). With the movement of the third link 85, the flange 129D is pushed by the sloping portion 85C, whereby the coupling pin 129 moves in the axial direction (the lateral direction in FIG. 5B).

Figure 6A:
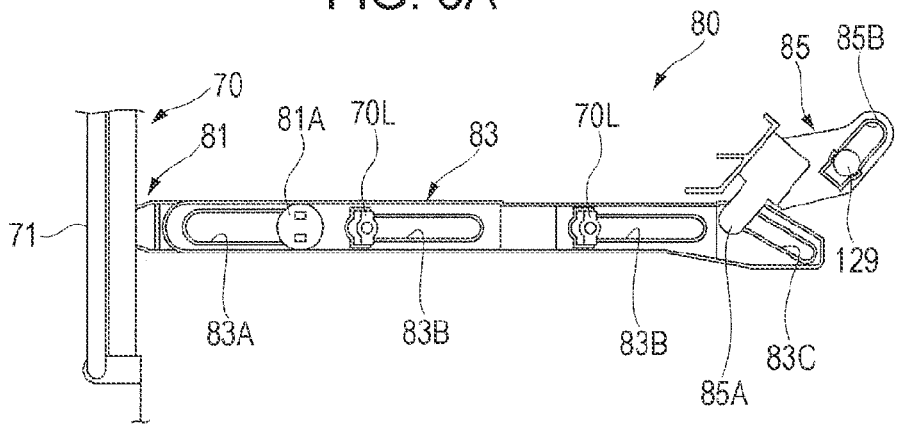
FIGS. 6A to 6C illustrate a series of movements of the link mechanism.
Figure 6B:
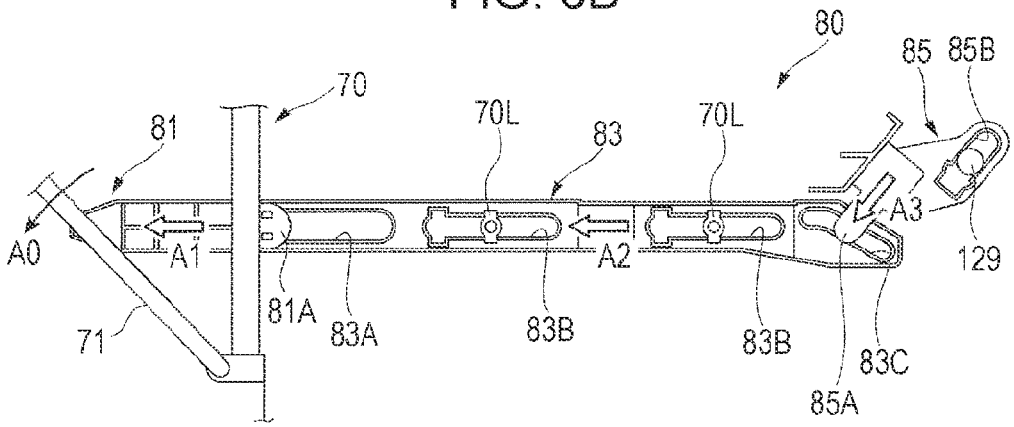
Figure 6C:
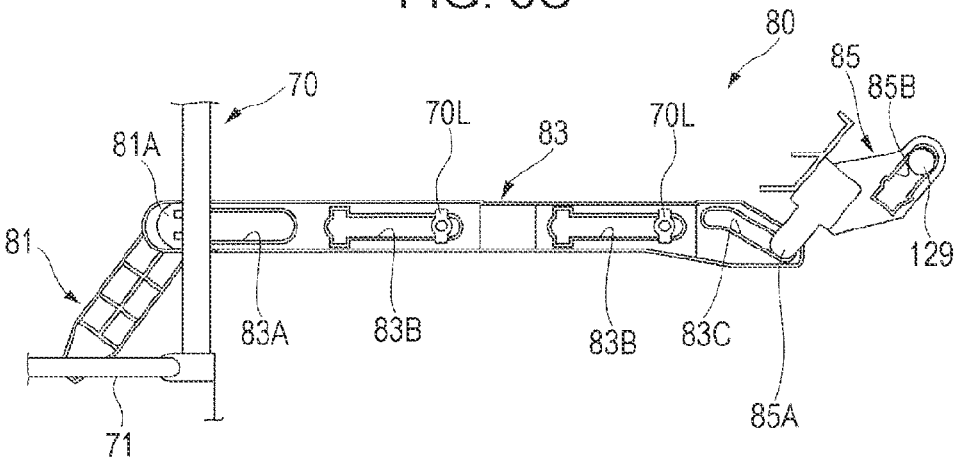

Referring now to FIGS. 6A to 6C, how the link mechanism 80 moves will be described. FIGS. 6A to 6C illustrate a series of movements of the link mechanism 80.

When the covering 71 that is in a closed state as illustrated in FIG. 6A is opened by the user, the covering 71 moves in a direction of arrow A0 illustrated in FIG. 6B, whereby the first to third links 81, 83, and 85 of the link mechanism 80 move in respective directions (represented by arrows A1 to A3 in FIG. 6B), and the covering 71 is fully open (see FIG. 6C).

Movement of Photoconductor-Drum-Driving Mechanism 120

Figure 7A:
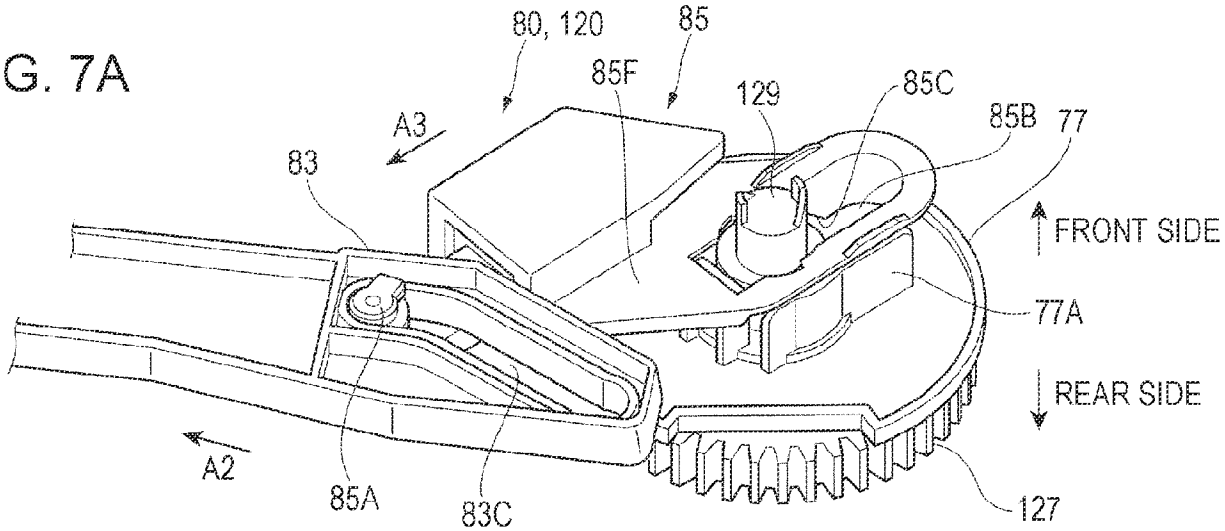
FIGS. 7A and 7B illustrate movements of a third link and the coupling pin.
Figure 7B:
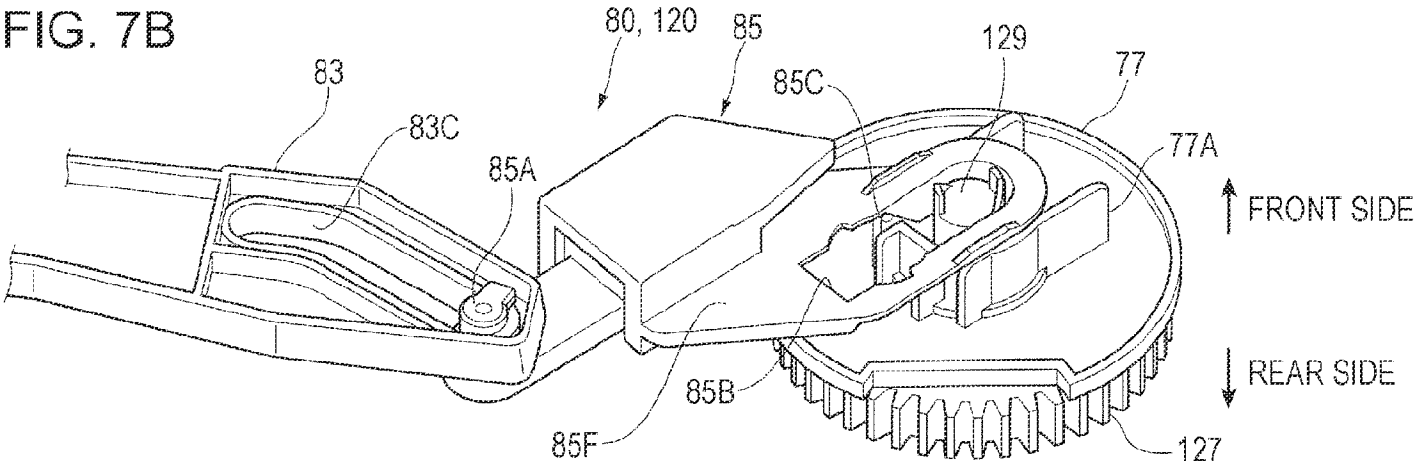
Figure 8:
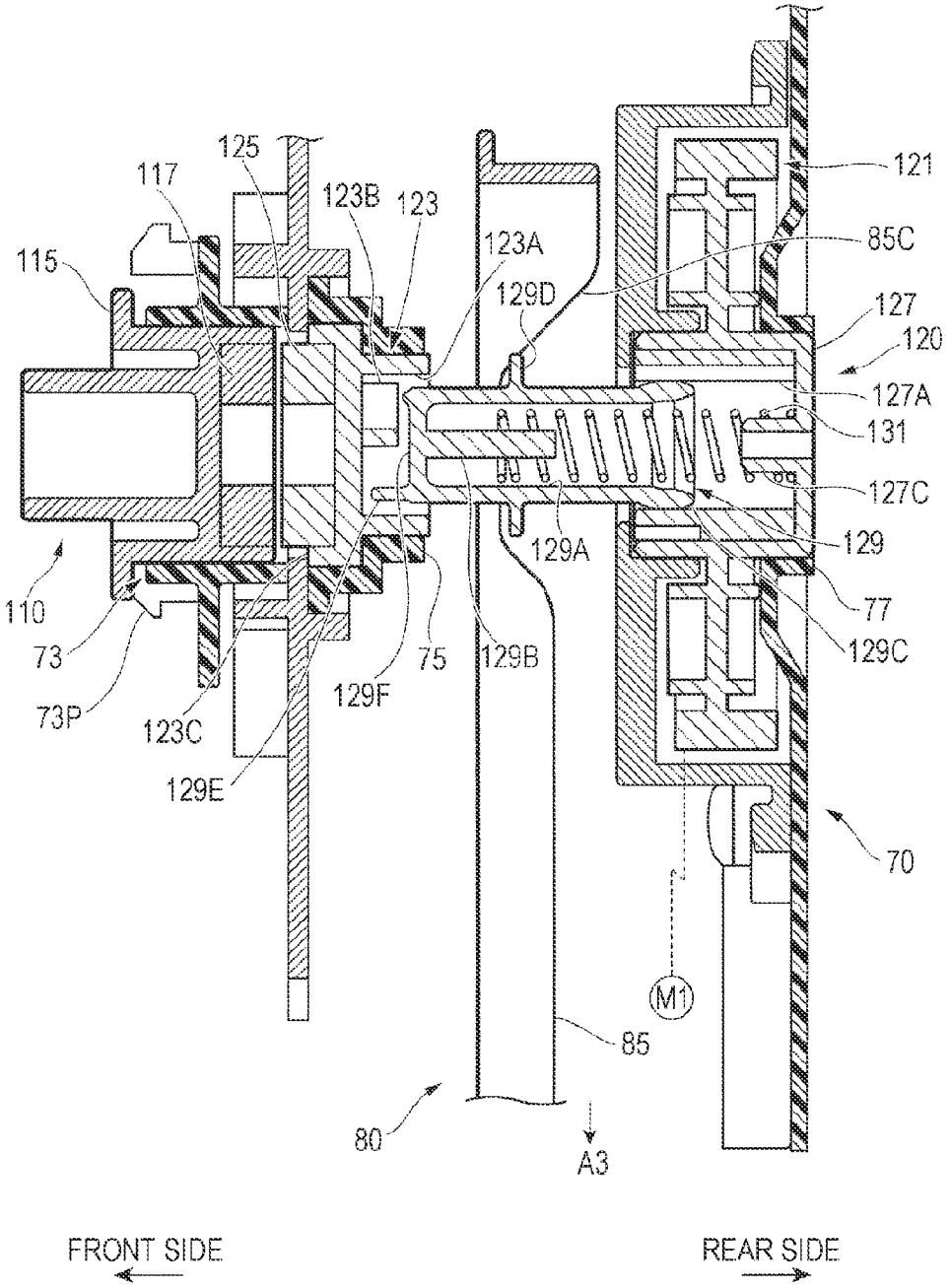
FIG. 8 illustrates a state of a photoconductor-drum-driving mechanism realized when a covering is closed.
Figure 9:
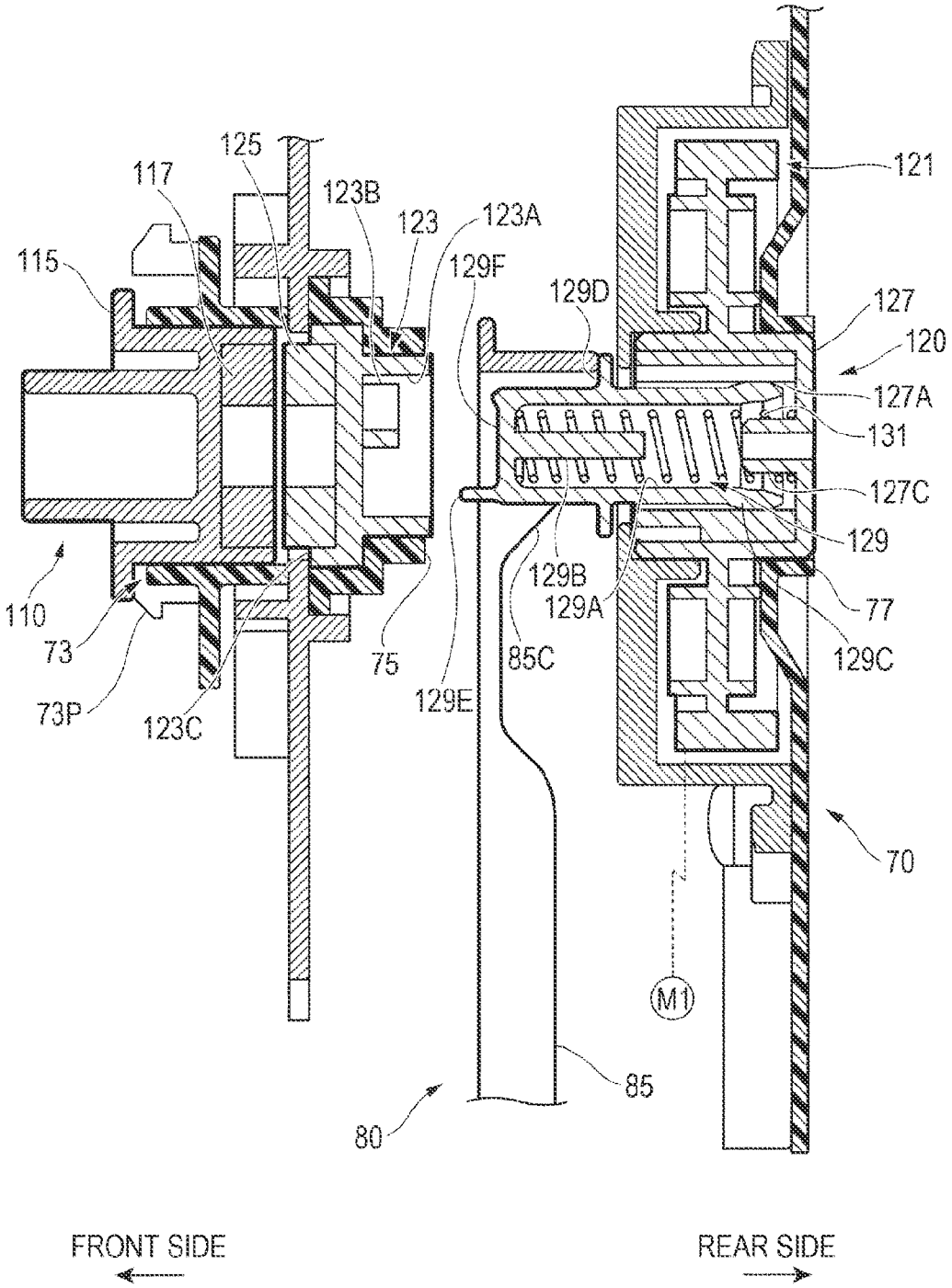
FIG. 9 illustrates a state of the photoconductor-drum-driving mechanism realized when the covering is open.

Referring now to FIGS. 7A, 7B, 8, and 9, how the photoconductor-drum-driving mechanism 120 moves with the above movement of the link mechanism 80 will be described. FIGS. 7A and 7B illustrate movements of the third link 85 and the coupling pin 129. FIG. 8 illustrates a state of the photoconductor-drum-driving mechanism 120 realized when the covering 71 is closed. FIG. 9 illustrates a state of the photoconductor-drum-driving mechanism 120 realized when the covering 71 is open.

First, a movement of the coupling pin 129 made along with the movement of the third link 85 of the link mechanism 80 will be described. As illustrated in FIG. 7A, in the state where the covering 71 is closed, the coupling pin 129 projects from the gear body 127. When the covering 71 is opened, the third link 85 moves (see arrow A3), whereby the sloping portion 85C of the third link 85 pushes the flange 129D of the coupling pin 129 toward the rear side. Consequently, as illustrated in FIG. 7B, the coupling pin 129 is embedded in the gear body 127.

Although detailed description is omitted, when the covering 71 that is in the open state is closed, the coupling pin 129 connected to the third link 85 of the link mechanism 80 moves from the position of being embedded in the gear body 127 (see FIG. 7B) to the position of projecting from the gear body 127 (see FIG. 7A).

How the states of connections among the elements included in the photoconductor-drum-driving mechanism 120 change with the movement of the link mechanism 80 will now be described. As illustrated in FIG. 8, in the state where the covering 71 (see FIG. 1) is closed, the coupling pin 129 is at the position of projecting from the gear body 127. In this state, the rib 123B of the gear-side-magnet-supporting member 123 resides in the path along which the catches 129E move with the rotation of the coupling pin 129 about the rotational axis.

When the covering 71 is opened, the third link 85 moves (see arrow A3 in FIG. 8) and the sloping portion 85C of the third link 85 pushes the flange 129D of the coupling pin 129 toward the rear side. Consequently, as illustrated in FIG. 9, the coupling pin 129 moves to the position of being embedded in the gear body 127. In this state, the coupling pin 129 is retracted from the gear-side-magnet-supporting member 123, and the rib 123B of the gear-side-magnet-supporting member 123 is retracted from the path along which the catches 129E moves with the rotation of the coupling pin 129. That is, the catches 129E are out of engagement with the rib 123B.

In such a state where the catches 129E and the rib 123B are not pressed against each other, the gear-side-magnet-supporting member 123 is rotatable independently of the coupling pin 129 or the coupling gear 121. More specifically, in the exemplary embodiment, in the state where the covering 71 is open, the gear-side-magnet-supporting member 123 and the gear-side magnet 125 are capable of rotating idly while being disconnected from the photoconductor-drum-driving mechanism 120 including the motor M1.

In other words, the photoconductor-drum-driving mechanism 120 according to the exemplary embodiment may be regarded as a unit including an idling mechanism that allows only some members to rotate idly, or a unit including a connecting-and-disconnecting mechanism that switches between a connected state (a fixed state or a transmittable state) realized when the covering 71 is closed and a disconnected state (an idle state) realized when the covering 71 is open.

With the above mechanism of cutting the transmission of the driving force by moving the coupling pin 129 in the axial direction, the length of the photoconductor-drum-driving mechanism 120 in a direction intersecting the axial direction of the coupling pin 129 is reduced.

Furthermore, since the transmission of the driving force is cut by moving the coupling pin 129 provided at a position nearer to the motor M1 than the gear-side magnet 125 and the drum-side magnet 117 as described above, the movements of the gear-side magnet 125 and the drum-side magnet 117 in the axial direction along with the cutting of the transmission of the driving force is suppressed.

Attaching of Photoconductor Drum Unit 110

Referring now to FIGS. 1, 3A to 3C, 4A and 4B, and 9, how individual members move when the photoconductor drum unit 110 is attached to the housing 70 will be described.

As described above, in the exemplary embodiment, the gear-side magnet 125 and the drum-side magnet 117 attract each other with their magnetism. Hence, when the gear-side magnet 125 rotates, the drum-side magnet 117 rotates. Thus, the driving force from the motor M1 included in the photoconductor-drum-driving mechanism 120 is transmitted to the photoconductor drum 11.

In attaching the photoconductor drum unit 110 to the housing 70 not having the photoconductor drum unit 110 yet, the phase relationship between the gear-side magnet 125 and the drum-side magnet 117 may be different from the predetermined phase relationship. More specifically, the relationship between each of the magnetic poles of the gear-side magnet 125 and a corresponding one of the magnetic poles of the drum-side magnet 117 may be different from that illustrated in FIG. 4A, that is, not a state where opposite magnetic poles face each other but a state where, for example, the same magnetic poles face each other. In such a case, a force acting to change the relative positions of the gear-side magnet 125 and the drum-side magnet 117 (a force that tends to restore the predetermined phase relationship) occurs with the magnetism.

The force acting to change the relative positions of the gear-side magnet 125 and the drum-side magnet 117 acts as a force causing the gear-side magnet 125 and the drum-side magnet 117 to rotate. Depending on the positional relationship between the gear-side magnet 125 and the drum-side magnet 117, the force may cause the photoconductor drum 11 to rotate in a backward direction opposite to the forward direction (indicated by arrow D0 in FIG. 1).

If the photoconductor drum 11 rotates in the backward direction, the cleaning member 16 provided in contact with the surface of the photoconductor drum 11 so as to clean the photoconductor drum 11 after the transfer may be rolled up. Furthermore, in an area where the photoconductor drum 11 and the developing roller 14A of the developing device 14 face each other, the developer carried by the developing roller 14A may be removed from the developing roller 14A. Consequently, the transferability may be deteriorated at the start of rotation of the photoconductor drum 11. Such phenomena lead to some deterioration in the quality of an image to be formed on the piece of paper P.

In the exemplary embodiment, however, the attaching and detaching of the photoconductor drum unit 110 are performed with the covering 71 open, as described above. In the state where the covering 71 is open, the gear-side-magnet-supporting member 123 and the gear-side magnet 125 rotate independently of the coupling pin 129 and the coupling gear 121. Hence, even if the phase relationship between the gear-side magnet 125 and the drum-side magnet 117 is different from the predetermined phase relationship, the rotation of the drum-side magnet 117 (the photoconductor drum unit 110) is suppressed.

More specifically, the exemplary embodiment employs a configuration that allows the gear-side-magnet-supporting member 123 and the gear-side magnet 125 to rotate alone. The load required for rotating the gear-side magnet 125 is smaller in the exemplary embodiment than in a configuration in which the gear-side-magnet-supporting member 123 and the gear-side magnet 125 are not rotatable alone unlike the configuration according to the exemplary embodiment. Hence, as a result of facilitating the rotation of the gear-side magnet 125 in changing the relative positions of the gear-side magnet 125 and the drum-side magnet 117, the rotation of the drum-side magnet 117 is suppressed (that is, the rotation of the photoconductor drum 11 in the backward direction is suppressed).

In the exemplary embodiment, the driving force (load) required for rotating the gear-side-magnet-supporting member 123 and the gear-side magnet 125 is set smaller than the driving force required for rotating the photoconductor drum unit 110. Therefore, the backward rotation of the photoconductor drum unit 110 is more assuredly suppressed.

The exemplary embodiment may be regarded as a configuration in which the shift in the phase relationship between the gear-side magnet 125 and the drum-side magnet 117 is adjusted after the photoconductor drum unit 110 is attached to the housing 70 and before the motor M1 is activated.

Instead of the photoconductor drum 11, the gear-side-magnet-supporting member 123 and the gear-side magnet 125 may be configured to rotate by modifying the exemplary configuration illustrated in the drawings such that the transmission of the driving force is cut by, for example, causing the coupling gear 121 or one of the train of gears (not illustrated) that transmit the driving force from the motor M1 to the coupling gear 121 to be retracted from a gear or the like engaging therewith.

In the exemplary configuration illustrated in the drawings, when the covering 71 is closed after the photoconductor drum unit 110 is attached to the housing 70, the coupling pin 129 connected to the third link 85 of the link mechanism 80 moves from the position of being embedded in the gear body 127 to the position of projecting from the gear body 127. With the coupling pin 129 projecting from the gear body 127, when the coupling pin 129 receives the driving force from the motor M1 and starts to rotate, the catches 129E of the coupling pin 129 engage with the rib 123B of the gear-side-magnet-supporting member 123, whereby the driving force is transmitted to the photoconductor drum unit 110.

Depending on the positional relationship between the photoconductor drum unit 110 and the coupling pin 129, when the coupling pin 129 moves from the position of being embedded in the gear body 127 to the position of projecting from the gear body 127, the catches 129E of the coupling pin 129 and the rib 123B of the gear-side-magnet-supporting member 123 may overlap each other in the circumferential direction and may be pressed against each other. In such a case, the spring 131 contracts, whereby the coupling pin 129 remains embedded in the gear body 127. In this state, when the coupling pin 129 receives the driving force from the motor M1 and starts to rotate, the sloping portions 129G of the catches 129E slide on the rib 123B, whereby the coupling pin 129 gradually projects from the gear body 127. Then, with the rotation of the coupling pin 129, the catches 129E engage with the rib 123B.

Modifications

In the above exemplary configuration illustrated in the drawings, the drum-side magnet 117 and the gear-side magnet 125 are each an annular plate-type magnet. Alternatively, the magnet coupling may include, for example, an annular magnet and a cylindrical magnet that encloses the annular magnet.

While the above exemplary configuration illustrated in the drawings concerns the photoconductor drum 11, the exemplary embodiment is also applicable to any other interchangeable rotating member included in the image forming apparatus 1. For example, the exemplary embodiment is applicable to any of the developing device 14, the transfer device 15, the fixing section 20, the toner cartridge 50, and other rotating members.

While the above exemplary configuration illustrated in the drawings concerns a case where the link mechanism 80 is connected to the covering 71, the link mechanism 80 is not necessarily be mechanically connected to the covering 71. For example, instead of mechanically connecting the link mechanism 80 to the covering 71, the link mechanism 80 may be moved by using a solenoid or the like so that the coupling pin 129 is retracted. In such a case, for example, a sensor that detects the opening of the covering 71 may be provided so that the solenoid is activated in response to a signal from the sensor. Thus, the shift in the phase relationship between the gear-side magnet 125 and the drum-side magnet 117 are more assuredly adjusted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

a driving portion provided in the housing and configured to generate a driving force;

an interchangeable member interchangeably provided in the housing and having a driving-force-receiving portion at which the driving force generated by the driving portion is received, the interchangeable member being configured to rotate by receiving the driving force at the driving-force-receiving portion;

a driving-force-transmitting portion provided in the housing and connecting the driving portion and the interchangeable member to each other, the driving-force-transmitting portion being configured to transmit the driving force from the driving portion to the interchangeable member; and a connecting-and-disconnecting mechanism that allows the driving force to be transmitted between the driving portion and the driving-force-transmitting portion when the interchangeable member rotates by receiving the driving force from the driving portion, and prevents the driving force from being transmitted between the driving portion and the driving-force-transmitting portion when the interchangeable member is to be attached to the housing, wherein the driving-force-transmitting portion includes a first magnet configured to rotate by receiving the driving force from the driving portion, and wherein the driving-force-receiving portion includes a second magnet facing the first magnet with a gap interposed therebetween and configured to rotate together with the first magnet while attracting and being attracted by the first magnet with magnetism.

2. The image forming apparatus according to claim 1, wherein, when the interchangeable member is to be attached to the housing, the connecting-and-disconnecting mechanism prevents the driving force from being transmitted via a path along which the driving force is transmitted from the driving portion to the first magnet.

3. The image forming apparatus according to claim 1, wherein the housing includes a portion having an opening that communicates with an inside of the housing and through which the interchangeable member provided in the housing is removable; and a covering member that covers the opening and is openable and closable, and wherein, when the covering member is opened, the connecting-and-disconnecting mechanism prevents the driving force from being transmitted between the driving portion and the driving-force-transmitting portion.

4. The image forming apparatus according to claim 1, wherein the connecting-and-disconnecting mechanism includes a rotating portion provided coaxially with the interchangeable member and configured to rotate; and a follower portion provided adjacent to the rotating portion in an axial direction of the rotating portion and configured to rotate by receiving the driving force from the rotating portion when an end of the follower portion that faces the rotating portion comes into contact with the rotating portion, and wherein the connecting-and-disconnecting mechanism prevents the driving force from being transmitted between the driving portion and the driving-force-transmitting portion by separating the rotating portion and the end of the follower portion from each other in the axial direction.

* * * * *